US012778312B2

(12) United States Patent
Lim et al.

(10) Patent No.: US 12,778,312 B2
(45) Date of Patent: Nov. 3, 2026

(54) FOAM MATTRESS CONTAINING VERTICALLY LAPPED NONWOVEN MATERIAL

(71) Applicant: Tintoria Piana US, Inc., Cartersville, GA (US)

(72) Inventors: Sang-hoon Lim, Cartersville, GA (US); Yang Yu, Cartersville, GA (US); Andrea Piana, Cartersville, GA (US); Ariel Guerra, Cartersville, GA (US); Eric McCann, Cartersville, GA (US)

(73) Assignee: Tintoria Piana US, Inc., Cartersville, GA (US)

( * ) Notice: Subject to any disclaimer, the term of this patent is extended or adjusted under 35 U.S.C. 154(b) by 0 days.

(21) Appl. No.: 19/034,000

(22) Filed: Jan. 22, 2025

(65) Prior Publication Data

US 2025/0235008 A1 Jul. 24, 2025

Related U.S. Application Data

(60) Provisional application No. 63/624,518, filed on Jan. 24, 2024.

(51) Int. Cl.

| | |
|---|---|
| ***A47C 27/15*** | (2006.01) |
| ***A47C 27/00*** | (2006.01) |
| ***A47C 27/12*** | (2006.01) |
| ***A47C 31/00*** | (2006.01) |

(52) U.S. Cl.

CPC ..... *A47C 27/15* (2013.01); *A47C 27/002* (2013.01); *A47C 27/122* (2013.01); *A47C 31/001* (2013.01)

(58) Field of Classification Search

CPC ..... A47C 27/15; A47C 27/148; A47C 27/002; A47C 27/122; A47C 31/00

USPC ..... 5/690, 740

See application file for complete search history.

(56) References Cited

U.S. PATENT DOCUMENTS

| | | | | |
|---|---|---|---|---|
| 4,164,797 | A * | 8/1979 | Golembeck | A44B 19/36 5/738 |
| 5,702,801 | A * | 12/1997 | Chien | D04H 1/74 156/181 |
| 2015/0147518 | A1* | 5/2015 | DeFranks | B32B 5/08 428/96 |
| 2018/0303247 | A1* | 10/2018 | Scudieri | A47C 31/105 |
| 2019/0298076 | A1* | 10/2019 | Lim | A47C 21/046 |
| 2020/0378057 | A1* | 12/2020 | Lim | A47C 27/002 |
| 2021/0161303 | A1* | 6/2021 | Lim | A47C 27/001 |
| 2022/0098770 | A1* | 3/2022 | Jafari | B32B 5/022 |
| 2023/0309708 | A1* | 10/2023 | Purani | A47C 27/127 5/709 |

FOREIGN PATENT DOCUMENTS

| | | | | |
|---|---|---|---|---|
| GB | 2549634 | A * | 10/2017 | A47C 27/22 |

* cited by examiner

*Primary Examiner* — J. T. Newton
(74) *Attorney, Agent, or Firm* — WCF IP

(57) ABSTRACT

A hybrid mattress includes a plurality of layers, comprising a top portion predominantly formed of one or more foam layers, which may be of the same or different types, and a bottom portion comprising 50% to 100% vertically lapped nonwoven material layers. The top surface layer of the plurality of layers may be a thin chemically treated vertically lapped nonwoven material.

5 Claims, 2 Drawing Sheets

FOAM MATTRESS CONTAINING VERTICALLY LAPPED NONWOVEN MATERIAL

CROSS-REFERENCE TO RELATED APPLICATIONS

This application claims priority to U.S. Ser. No. 63/624,518 filed on Jan. 24, 2024, and the complete contents thereof is herein incorporated by reference.

FIELD OF THE INVENTION

The present invention relates to a mattress containing both foam materials and vertically lapped nonwoven materials.

BACKGROUND

Foam mattresses are widely utilized for their comfort and adaptability; however, they possess inherent drawbacks, including heat retention, limited breathability, and excessive weight. These issues can adversely affect thermal regulation, moisture management, and overall user comfort, ultimately compromising sleep quality. Accordingly, there exists a need for an improved mattress design that addresses these limitations while maintaining or enhancing the desirable properties of conventional foam mattresses.

SUMMARY OF THE INVENTION

Foam mattresses inherently possess limitations such as heat retention, restricted airflow, heavy weight, and susceptibility to material degradation over time, which may adversely affect factors critical to an enhanced sleep and usage experience, including thermal comfort, breathability, and durability.

To address the drawbacks of traditional foam mattresses, a hybrid mattress structure incorporating nonwoven materials as partial replacements for foam layers is proposed. The preferred nonwoven material is a vertically lapped nonwoven. By integrating the nonwovens, the mattress can achieve superior airflow, enhanced heat dissipation, and improved moisture management. Additionally, the substitution of foam with nonwoven materials results in a lighter-weight construction, facilitating easier handling and transportation.

Furthermore, utilizing the nonwovens composed of recycled or biodegradable fibers enhances the mattress's sustainability by reducing reliance on petroleum-based foam materials and minimizing environmental impact.

The hybrid mattress will include predominantly foam or foam layers at or towards the top on which the person will sleep, and will include a significant amount of nonwoven or nonwoven layers at or towards the bottom on the opposite side where the person sleeps. The foam layers positioned at the top enhance resiliency and springback, ensuring a comfortable sleep experience by accommodating the movements of a person throughout the night. The nonwoven layers positioned toward the bottom of the mattress facilitate air passage at rates that are not readily achievable with foam layers. This allows the person to be relatively cooler while he or she sleeps than would be the cases on a traditional solid foam mattress. Further, as the nonwoven layers are made from fibers, and in preferred embodiments, natural fibers or at least readily biodegradable and/or recyclable fibers, the hybrid mattress has considerably lower environmental impact than traditional foam mattresses, both in terms of manufacturing the mattress and in disposing of or recycling the mattress. The hybrid mattress, configured as discussed herein, optimizes comfort, support, and sustainability while mitigating the inherent disadvantages of conventional foam mattresses.

DETAILED DESCRIPTION

Figure 1:
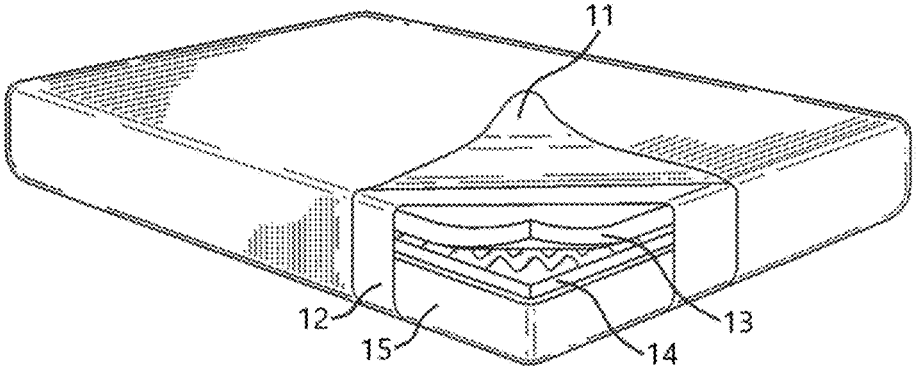
FIG. 1 illustrates an example of a conventional foam mattress.

The present invention relates to a foam mattress incorporating vertically lapped nonwovens as partial replacements for foam layers, and particularly to a hybrid mattress which includes foam or foam layers towards the top on which a person sleeps and nonwoven layers towards the bottom opposite the sleeping surface.

As discussed herein, the term "a nonwoven" is synonymous with "a nonwoven material". A vertically lapped nonwoven, is a particularly preferred material for the hybrid mattress, and can be produced by commercially available machines, such as V-Lap vertical lapping systems sold by V-Lap Pty Ltd. and by Struto International, Inc. In the V-Lap system, staple fiber blend including binder fibers are opened, blended, and carded. The carded fiber web is pleated and the fibers are bonded mechanically (needling) and thermally to produce vertically lapped nonwovens. In the Struto system, the carded fiber web containing binder fiber is fed into the Struto lapping device. The vertical lapper then folds the web into a uniform structure. The folds are compressed together into a continuous structure, which is held in vertical position as it passes the heated thermal bonding oven.

Due to its vertical fiber arrangement, the vertically lapped nonwovens provide better resilience and shape recovery to compression compared to cross lapped nonwovens. Especially when the vertically lapped nonwoven is made with elastic binder fibers and high resilience fibers, it provides a very good resilience. As examples of elastic polyester binder fibers, ELK®, E-PLEX®, and EMF type high elastic LMF are commercially available from Teijin Limited, Toray Chemical Korea Inc., and Huvis Corporation, respectively. The elastic polyester binder fiber provides elastic property to the nonwoven and provides bonding between fibers after the thermal bonding process. To provide bulkiness and resilience to the nonwoven, hollow or hollow conjugate polyester fiber can be used together with the binder fibers, such as the elastic binder polyester fiber, conventional binder fibers, or combination of these. To increase the density of the nonwoven, high shrink polyester fiber can be added to the blend. In addition to these fiber, other fibers can be used to give other required functions. Type of polyester includes, but not limited to PET (polyethylene terephthalate), PTT (polytrimethylene terephthalate), and PBT (polybuthylene terephthalate). The most used polyester is PET. In this invention, recycled or biodegradable polyester fibers are preferably utilized.

Examples of fiber blends for the vertically lapped nonwovens which can be advantageously used in the invented mattress include but are not limited to the following:

- Elastic polyester binder fiber (6 denier×64 mm):High shrink polyester fiber (1.4 denier×51 mm):Low-melt polyester binder fiber (4 denier×51 mm): Regular polyester fiber (6 denier×51 mm)=25:20:10:45
- Hollow conjugate polyester fiber (3 denier×51 mm): Elastic polyester binder fiber (6 denier×64 mm)=60:40
- Polyester fiber (15 denier×51 mm):Elastic polyester binder fiber (6 denier×51 mm)=70:30
- Hollow polyester fiber (12 denier×64 mm):Low-melt polyester binder fiber (4 denier×51 mm)=70:30
- Hollow conjugate polyester fiber (3 denier×51 mm):High shrink polyester fiber (1.4 denier×51 mm):Elastic polyester binder fiber (6 denier×64 mm):Low-melt polyester binder fiber (4 denier×51 mm)=40:20:30:10
- Hollow polyester fiber (6 denier×64 mm):Elastic polyester binder fiber (6 denier×64 mm)=70:30
- Polyester fiber (1.5 denier×51 mm):polyester fiber (6 denier×51 mm):Elastic polyester binder fiber (6 denier×64 mm):Low-melt polyester binder fiber (4 denier×51 mm)=40:20:30:10

The vertically lapped nonwoven may be made from man-made or/and natural fibers together with binder fibers, such as the elastic binder polyester fiber, low-melt or high-melt binder fiber, or combinations of these. The nonwoven will preferably include at least 35-90% polyester fiber (e.g., hollow polyester, hollow conjugate polyester, regular polyester fiber, high shrink polyester fiber, conventional polyester binder fiber, or combination of these). The nonwoven will preferably contain at least 10-50% elastic polyester binder fiber. Additional man-made (e.g., rayon, lyocell, Nylon, Kevlar, etc.) and/or natural fibers (e.g., cotton, jute, silk, wool, linen, cashmere, etc.) may also be included.

The vertically lapped nonwovens include a significant amount of fibers that are in a vertical direction, so they can provide a good firmness and resilience that are comparable to those of the foams as well as they provide better breathability compared to foams.

The basis weight of single nonwoven layer will vary depending on mattress design but the preferred basis wt will be 150~1800 g/m$^2$. The thickness of single layer of the nonwoven will vary depending on mattress design but the preferred thickness will be 0.3~3 inches.

FIG. 1 shows an example of a foam mattress. In construction, a top layer 11 (usually zippered cover) is positioned over a FR (flame retardant) knit cover 12 (referred to as FR socks or FR caps), and one or more foam layers 13, 14, 15 (one or more of which may be memory foam (viscoelastic foam), latex foam, or conventional polyurethane (PU) foam).

In the hybrid mattress of this invention, the bottom part of foam layers of the foam mattress is or are replaced with one or more vertically lapped nonwoven layers. The foam and nonwoven layers are preferably glued or bonded together. The foam layer can be one single block or multiple layers. The total thickness of the foam layer(s) is 3" or thicker. Preferably, it is 4" or thicker.

Figure 2:
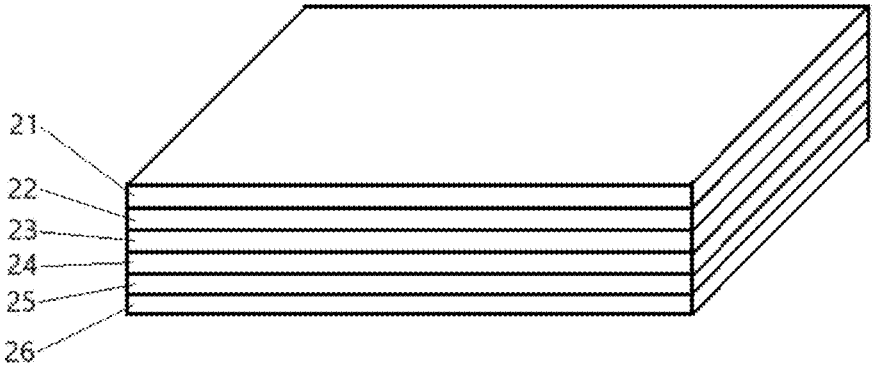
FIG. 2 illustrates an example of the material layers in a hybrid mattress according to the invention, wherein multiple foam layers are positioned at the top portion of the layers, and multiple vertically lapped nonwoven layers are positioned toward the bottom portion.

FIG. 2 shows an example of the assembly of material layers for a queen size hybrid mattress, comprising layers of foam and vertically lapped nonwoven. From the top, it is comprised of one layer of 2" viscoelastic foam 21, two layers of 2" conventional PU foam 22, 23, and three layers of 2" vertically lapped nonwoven 24, 25, and 26. All layers are preferably glued together. The assembled layers will be covered with a flame retardant cover and then with a zippered cover to be the final form of a mattress. That is, the mattress comprises 50% of its thickness formed by foam layers and 50% by vertically lapped nonwoven layers. The top portion of the mattress utilizes two different types of foam. The two layers of conventional PU foam, 22 and 23, may either be the same or of different types. Similarly, the three layers of vertically lapped nonwoven, 24, 25, and 26, may differ in properties such as fiber composition, density, and firmness.

Figure 3:
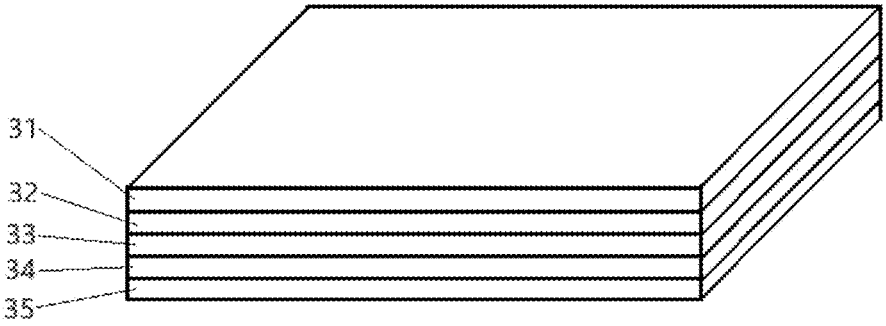
FIG. 3 illustrates an example of the material layers in a hybrid mattress similar to that shown in FIG. 2 except that there are less foam layers than nonwoven layers.

FIG. 3 illustrates another example of the assembly of material layers in a queen-size hybrid mattress constructed with layers of foam and vertically lapped nonwoven material. From the top, the assembly comprises one layer of 2" viscoelastic foam 31, one layer of 2" conventional PU foam 32, and three layers of 2" vertically lapped nonwoven 33, 34, and 35. All layers are preferably glued together. The assembly is enclosed with a flame-retardant cover, followed by a zippered cover, forming the final mattress configuration. The mattress comprises 40% of its thickness formed by foam layers and 60% by vertically lapped nonwoven layers. The three layers of vertically lapped nonwoven 33, 34, and 35 may differ in properties such as fiber composition, density, and firmness.

For better durability of the hybrid mattress (i.e., the ability to withstand repeated application of pressure and be able to return to initial thickness), the top portion or at least a majority of the top portion of the layer assembly in a hybrid mattress must be formed with layers of foam. Specifically, the top half or at least the top 3" or 4" of the layer assembly should be a foam block or foam layers, while the bottom half or more of the layer assembly may contain zero, or one or more layers of foam, and one or more layers of vertically lapped nonwoven. The thickness of layers of vertically lapped nonwoven below the 3" or 4" or more of foam layer(s) can be between 100% and 50% of the total layer assembly thickness below the 3" or 4" or more of foam layer(s). For example, the 3" to 15" below the top 3" or 4" of foam layers. The inclusion of the vertically lapped nonwoven in the mattress results in a generally lighter mattress, with enhanced breathability through the vertically lapped nonwoven layers compared to the foam layers. The inclusion of the 3" or 4" or more of foam or foam layers at the top of the layer assembly of the mattress provides the durability of the mattress that is not readily achieved with vertically lapped nonwoven material.

The invention can be practiced with hybrid mattresses having the assembled layers' total thickness ranging from 5" to 18", where at least a portion, and preferably 20-83% of the thickness is comprised of vertically lapped nonwoven layers. The top 3" or 4" or more of the layer assembly will be foam layers. Below the top 3" or 4" or more of foam layers, there will be layers of vertically lapped nonwoven or combinations of vertically lapped nonwoven layers and foam layers or layers of other material in combination with the vertically lapped nonwoven layers and foam layers or layers of other material in combination with the vertically lapped nonwoven layers.

In some embodiments, to ensure cooling or other properties, a top surface layer of vertically lapped nonwoven material 1" or less in thickness (e.g., 0.6, 0.5, or 0.4 inches, etc.) may be positioned at the top of the layer assembly above the one or more layers of foam forming the top 3" or 4" or more of the layer assembly of the hybrid mattress.

Figure 4:
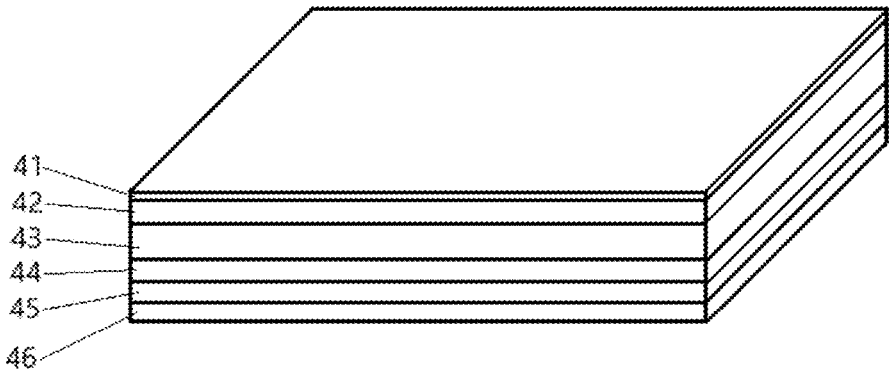
FIG. 4 illustrates an example of the material layers in a hybrid mattress similar those shown in FIG. 2 and FIG. 3, but where there is a thin layer of nonwoven on top of the foam layers.

FIG. 4 illustrates another example of a queen-size layer assembly constructed with layers of foam and vertically lapped nonwoven materials. From top to bottom, the assembly comprises: one layer of 0.5" vertically lapped nonwoven 41 (a top surface layer) which may be treated with chemicals (e.g., fire retardant, phase change materials for providing "coolness" to the person sleeping, scent for providing a smell to the person sleeping, antimicrobials for inhibiting bacterial growth in the mattress, etc.), one layer of 2" viscoelastic foam 42, one layer of 3" conventional PU foam 43, and three layers of 2" vertically lapped nonwoven 44, 45, and 46. That, is approximately 45% of the top portion of the assembly is foam, and 55% of the bottom portion of the assembly is vertically lapped nonwoven, and a thin top layer of vertically lapped nonwoven is on the very top of the assembly. The very thin layer allows for breathability while also offering specialized functionalities designed to enhance a person's sleep experience. All layers are preferably glued together. The assembled layers are enclosed within a flame-retardant cover, followed by a zippered cover, forming the final mattress structure. The top vertically lapped nonwoven layer 41 may be treated with a silver-based antimicrobial agent, microencapsulated phase change material (PCM), and microencapsulated lavender scent to enhance thermal regulation, suppress microbial growth, and provide a pleasant sleep experience. The three layers of vertically lapped nonwovens 44, 45, and 46 may differ in properties such as fiber composition, density, and firmness.

In this invention, depending on the special functions required by the hybrid mattress, the vertically lapped nonwoven material can be treated with various chemicals before building the mattress. Exemplary chemicals include but not limited to water/oil repellents, antimicrobials, flame retardants, microencapsulated scents, microencapsulated cosmetics, microencapsulated essential oils, microencapsulated phase change material (PCM), probiotics, odor control agents, photocatalytic agents, UV absorbers, anti-allergens, probiotics, hydrophilic agents, hydrophobic agents, thermally conductive materials, electrically conductive materials, hand modifying agents, antistatic agents, insect repellents, bed-bug repellents, dust mite repellents, liquid elastomer, firmness reducing agent, firmness increasing agent, fine porous particles for acoustic performance, and ceramics that emit far infrared and/or negative ions. The chemical formulations may include two or more different agents and/or two or more of the same class of agents (e.g., two different UV absorbers and one antistatic agent). In some applications, these chemicals can be combined to provide multi-functions on the treated nonwovens. In some applications, colors can be added to the formulation. An example chemical formulation that can be applied to a nonwoven comprises microencapsulated PCM, microencapsulated scent, binder, wetting agent, and water.

As it will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible. Additionally, any signal hatching depicted in the drawings or figures is to be understood as exemplary and not limiting, unless expressly stated otherwise.

While the present invention has been described in terms of preferred embodiments, those skilled in the art will recognize that the invention can be practiced with considerable modification within the spirit and scope of the appended claims.

It is noted that, as used herein and in the appended claims, the singular forms "a", "an", and "the" include plural referents unless the context clearly dictates otherwise. Furthermore the 3", 4", and 5-18" etc. designate "inches". Having thus described the invention in rather full detail, it will be understood that such detail need not be strictly adhered to, but that additional changes and modifications may suggest themselves to one skilled in the art, all falling within the scope of the invention as defined by the subjoined claims.

The invention claimed is:

1. A mattress, comprising:

an assembly of material layers joined together to form the mattress, wherein the mattress has a top and a bottom, wherein the mattress has a total thickness ranging from 5 to 18 inches thick, wherein the assembly of material layers comprises a top surface layer positioned on the top of the assembly of material layers, wherein the top surface layer is a vertically lapped nonwoven material that has a thickness of 1" or less, wherein the top surface layer is treated with one or more chemicals;

one or more layers of foam positioned directly under the top surface layer, wherein the one or more layers of foam are at least 3 inches thick;

a plurality of layers of vertically lapped nonwoven material wherein at least one of the plurality of layers of vertically lapped nonwoven material is positioned directly under the one or more layers of foam, wherein the plurality of layers of vertically lapped nonwoven material comprise 50-100% of a thickness portion of the mattress below the one or more layers of foam that is at least 3 inches thick.

2. The mattress of claim 1, further comprising a flame retardant cover which encases the assembly of material layers.

3. The mattress of claim 2, further comprising a zippered cover which fits over the flame retardant cover.

4. The mattress of claim 1 wherein the one or more layers of foam is a single block of foam at least 3" thick.

5. The mattress of claim 1 wherein the chemical treatment in the top surface layer comprises one or more of water/oil repellents, antimicrobials, flame retardants, microencapsulated scents, microencapsulated cosmetics, microencapsulated essential oils, microencapsulated phase change material (PCM), probiotics, odor control agents, photocatalytic agents, UV absorbers, anti-allergens, probiotics, hydrophilic agents, hydrophobic agents, thermally conductive materials, electrically conductive materials, hand modifying agents, antistatic agents, insect repellents, bed-bug repellents, dust mite repellents, liquid elastomer, firmness reducing agent, firmness increasing agent, fine porous particles for acoustic performance, and ceramics that emit far infrared and/or negative ions.

* * * * *